US005971720A

United States Patent [19]

Fagotti et al.

[11] Patent Number: 5,971,720

[45] Date of Patent: Oct. 26, 1999

[54] SUCTION MUFFLER FOR A HERMETIC COMPRESSOR

[75] Inventors: Fabian Fagotti; Edmar Baars, both of Joinville, Brazil

[73] Assignee: Empresa Brasileira de Compressores, Joinville-SC, Brazil

[21] Appl. No.: 09/029,482

[22] PCT Filed: Aug. 20, 1997

[86] PCT No.: PCT/BR97/00042

§ 371 Date: Apr. 9, 1998

§ 102(e) Date: Apr. 9, 1998

[87] PCT Pub. No.: WO98/07987

PCT Pub. Date: Feb. 26, 1998

[30] Foreign Application Priority Data

Aug. 21, 1996 [BR] Brazil ..... 9604126

[51] Int. Cl.[6] ..... F04B 53/00

[52] U.S. Cl. ..... 417/312; 417/902; 181/403

[58] Field of Search ..... 417/312, 902; 181/403

[56] References Cited

U.S. PATENT DOCUMENTS 5,496,156 3/1996 Harper .
5,577,898 11/1996 Lee .
5,733,106 3/1998 Lee ..... 417/312

FOREIGN PATENT DOCUMENTS 2 020 151 7/1970 France .
2 601 417 1/1988 France .
2 190 151 11/1987 United Kingdom .
2 288 857 11/1995 United Kingdom .

*Primary Examiner*—John Kwon
*Attorney, Agent, or Firm*—Darby & Darby

[57] ABSTRACT

A suction muffler for a hermetic compressor, comprising a hollow body (10) affixing a gas duct (20) which is defined by a gas inlet portion (21) having an inner end (21*a*) internal to said muffler body and an outer end (21*b*) external to said muffler body and in fluid communication with a suction inlet tube (8) provided in the hermetic shell (1) of the compressor, and a gas outlet portion (22) having an inner end (22*a*) internal to said muffler body and an outer end (22*b*) external to said muffler body and connected to a suction orifice, which is provided in the head (5) of a cylinder disposed inside the shell (1) and where is mounted the suction muffler, the extension of the gas duct (20) internal to the hollow body (10) being spaced from the walls thereof.

8 Claims, 2 Drawing Sheets

SUCTION MUFFLER FOR A HERMETIC COMPRESSOR

FIELD OF THE INVENTION

The present invention refers to a suction muffler for a hermetic compressor of the reciprocating type used in refrigeration systems.

BACKGROUND OF THE INVENTION

The prior art reciprocating hermetic compressors are, as a rule, provided with suction acoustic dampening systems (acoustic filters) inside the shell, with the function of attenuating the noise generated during the suction of the refrigerant fluid.

One of the causes which reduces the efficiency of the compressors using the present acoustic mufflers is the overheating of the gas being drawn. During the time elapsed between the entrance to the compressor and the admission into the cylinder thereof, the gas temperature is increased, due to the heat transferred from the several hot sources existing inside the compressor. The temperature increase causes an increase in the specific volume and consequently a reduction of the refrigerant mass flow. Since the refrigerating capacity of the compressor is directly proportional to the mass flow, reducing said flow results in efficiency loss.

It is well known that the thermal insulation of the gas being drawn by a hermetic compressor during its travel inside the hermetic shell of said compressor, from the suction inlet tube to the suction orifice, has a significant effect in relation to the increase of the refrigerating capacity and compressor efficiency. Among the means used to provide the thermal insulation, the more effective one is the use of an acoustic muffler in the form of a suction chamber of plastic material, provided with a tube to conduct gas from within the hermetic shell towards the suction orifice in the cylinder head. Said muffler, when the assembly is mounted, is suspended in relation to the body of said chamber (U.S. Pat. No. 4,755,108). The distribution of volumes and tubes and respective openings in the acoustic muffler is what characterizes, acoustically, the dampening effect of the noise generated in the gas suction. In order that the noise be dampened, the tube which conducts the gas to the suction chamber should be provided with openings communicating the inside of said tube with the internal volumes of the muffler. It is thus characterized, in the same assembly, a sequence of tubes disposed in series. The various tube sections are disposed in such a way as to provide a direction of the gas being drawn, avoiding the mixture of this cooler gas being drawn with the hotter gas found inside the chamber volumes.

In one known solution (U.S. Pat. No. 4,755,108), the construction of the acoustic muffler allows small leaks to occur in the connections of the two parts that normally form the tube. Said leaks, in more serious cases, substantially reduce the muffler efficiency in acoustic terms. There is also an additional complication related to the manufacturing process, owing both to the number of pieces involved (usually four) and to the usually more complex geometry of said pieces, resulting from the little space available inside the hermetic shell of the compressor.

One way used to overcome such deficiency, also known in the prior art (U.S. Pat. No. 4,960,368) is based on the configuration of the tubes and volumes defined in the muffler body, which reduces the number of pieces, without impairing the acoustic characteristic of the muffler. Nevertheless, in this solution there is some loss in the performance related to the heat conducted from the muffler body to the gas. This occurs as a function of the contiguity of the faces of the tube which conducts the gas to the cylinder with the internal invironment of the compressor, which is at a higher temperature.

DISCLOSURE OF THE INVENTION

It is an object of the present invention to provide a suction acoustic muffler for a hermetic compressor, which presents the advantages of the known solutions and which uses a gas flow directed during suction and thermically insulated from the hottest regions of the muffler.

Another object of the present invention is to provide a muffler with the above cited characteristics, which is obtained with a small number of components (two plastic pieces), without using complex geometries and which can be easily produced and mounted.

These and other objectives are achieved through a suction muffler for a hermetic compressor including a hermetic shell and having a suction inlet tube for gas admission therewithin, and a suction orifice which is provided in the head of a cylinder disposed inside the shell and where is mounted the suction muffler, said muffler comprising a hollow body affixing a gas duct which is defined by a gas inlet portion having an inner end internal to the muffler body and an outer end external to said muffler body and in fluid communication with the suction inlet tube, and a gas outlet portion having an inner end internal to the muffler body and an outer end external to said muffler body and connected to the suction orifice, the extension of the gas duct internal to the muffler body being spaced from the walls thereof.

According to the present invention, since there is a spacing of the gas duct in relation to the walls which define the substantially hermetic body of the muffler and consequently in relation to the hottest parts of the compressor, there is a reduction in the heating of the gas being drawn with a consequent improvement in terms of refrigerating capacity and efficiency, as compared to the prior art known solutions. In this solution, the acoustic dampening principle is reactive, which is advantageous in terms of efficiency. Moreover, the present solution allows the use of longer tubes, increasing the acoustic attenuation of the chamber.

BRIEF DESCRIPTION OF THE DRAWINGS

The invention will be described below, with reference to the attached drawings, in which.

BEST MODE FOR CARRYING OUT THE INVENTION

Figure 2:
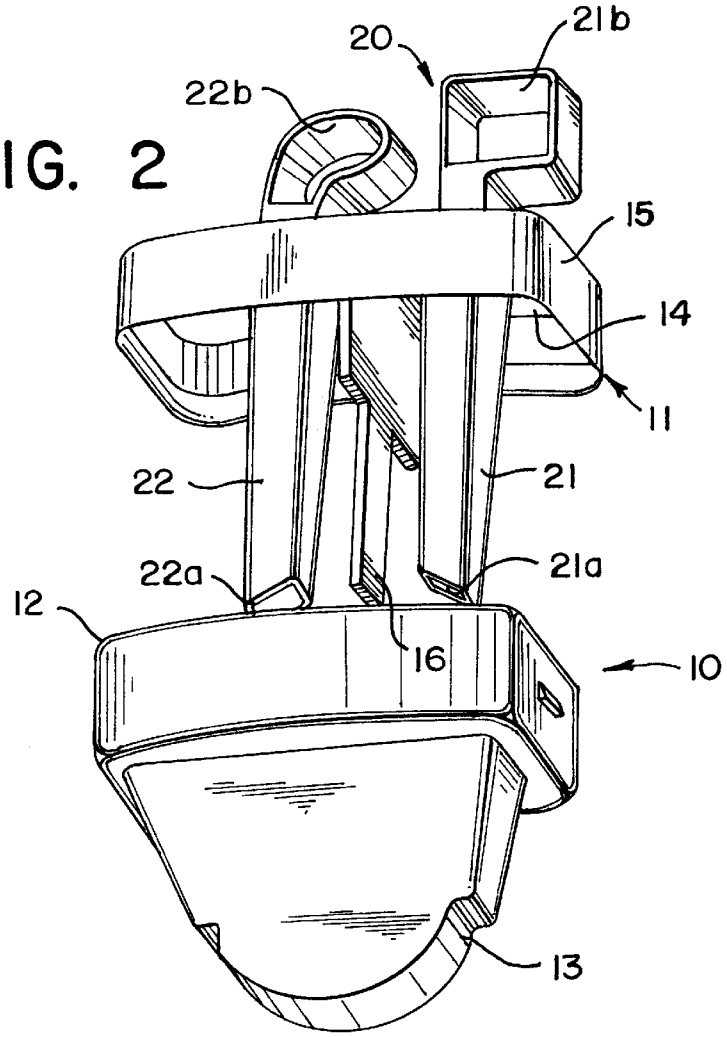
FIG. 2 is a schematic perspective view of the acoustic muffler constructed according to the present invention before the assembly of its component parts.
Figure 1:
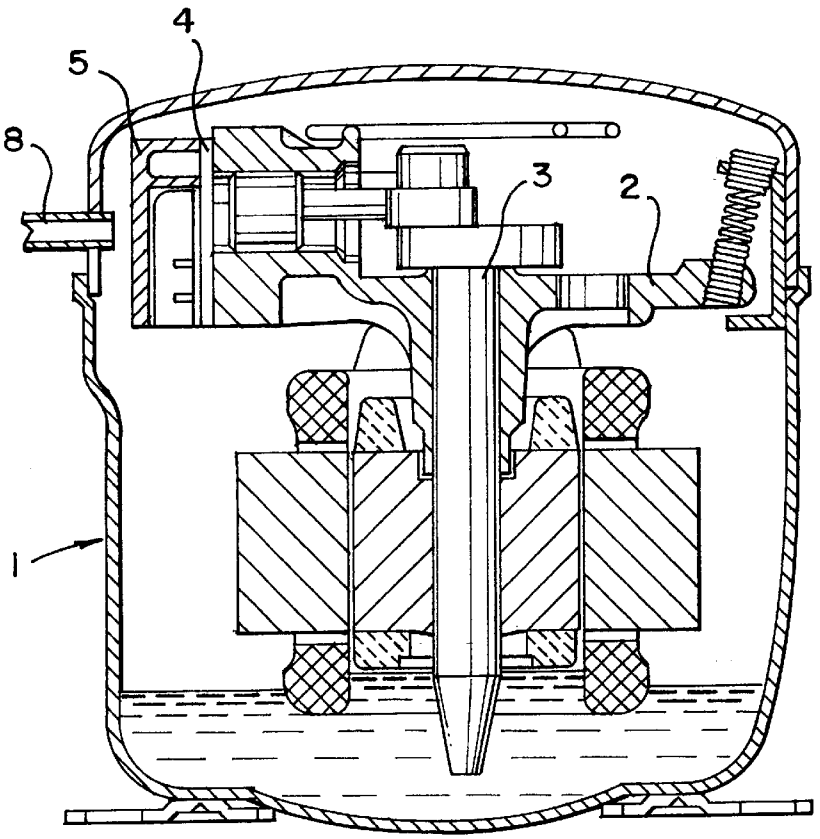
FIG. 1 is a schematic longitudinal vertical sectional view of a hermetic compressor of the reciprocating type.
Figure 4:
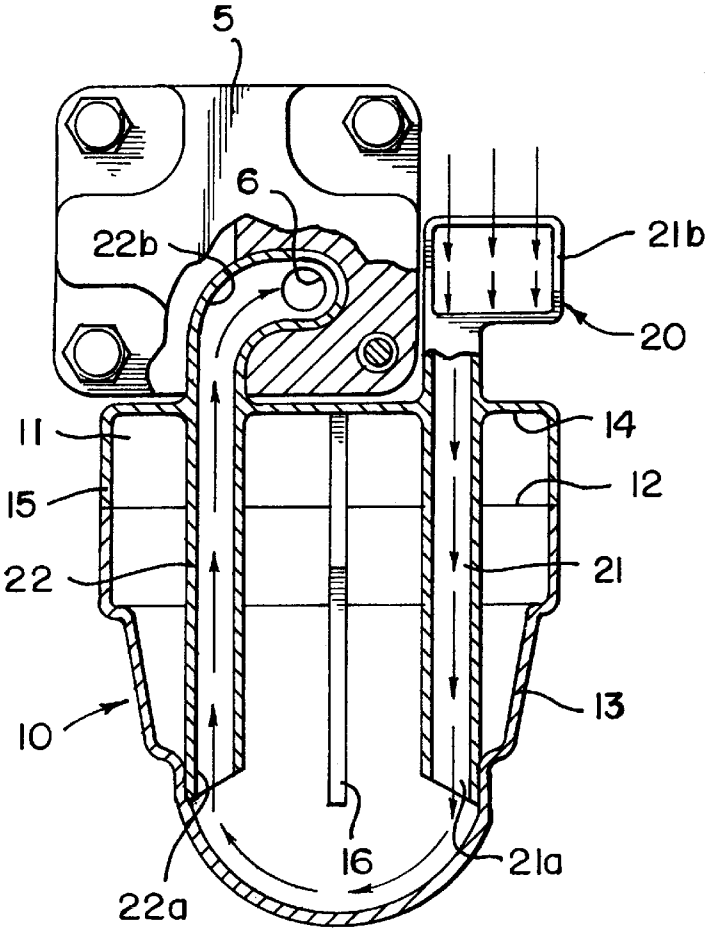
FIG. 4 is a schematic perspective view of the head and the suction system of the compressor.
Figure 3:
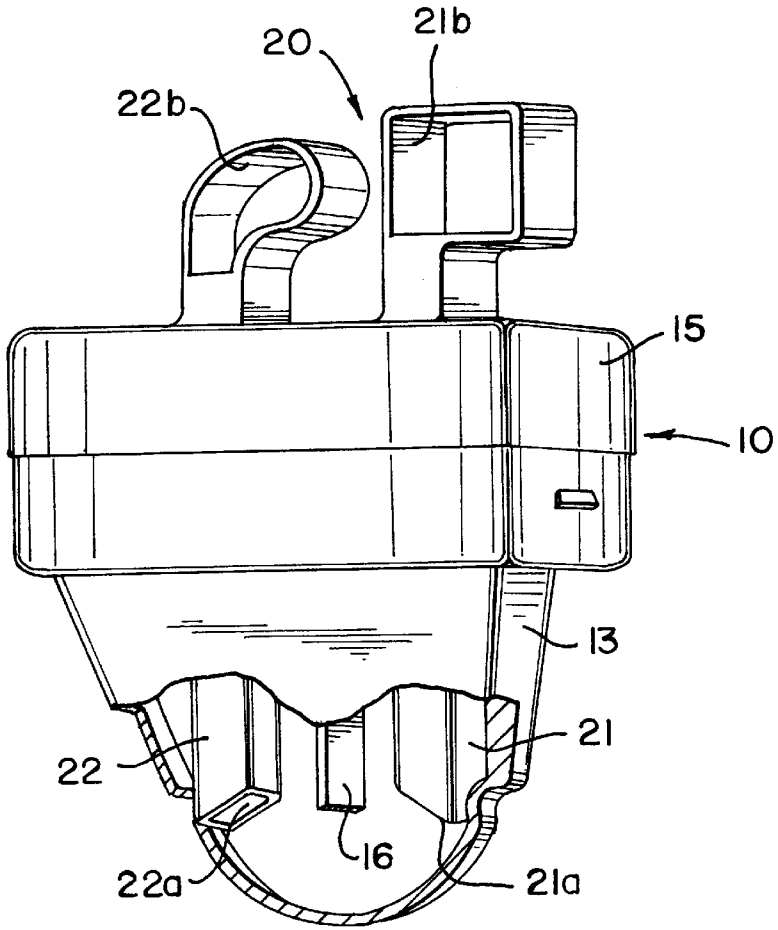
FIG. 3 is a schematic perspective view of the acoustic muffler of FIG. 2 in its mounted condition, partially illustrating the inside of its body.

The acoustic muffler of the present invention is used in a hermetic compressor of the reciprocating type comprising a shell 1, which is hermetic and inside which is suspended, e.g. by springs, a motor-compressor unit including a cylinder block 2, which lodges inside a cylinder a piston 3 that reciprocates within said cylinder 22, drawing and compressing the refrigerant gas when driven by the electric motor.

Said cylinder has an open end, which is closed by a valve plate 4 affixed to said cylinder block 2 and provided with suction and discharge orifices. Said cylinder block 2 further carries a head 5, which is mounted onto said valve plate 4 and which defines internally therewith a suction chamber 6 and a discharge chamber 7, which are maintained in selective fluid communication with the cylinder through the respective suction and discharge orifices. This selective communication is defined by opening and closing said suction and discharge orifices by the respective suction and discharge valves.

Shell 1 further carries a suction inlet tube mounted in an admission orifice, which is provided at shell 1 and opened to the inside thereof and through which arrives the cool gas to be drawn, e.g. by a suction pipe, which is external to said shell 1 and which is coupled to an evaporator of a refrigeration system to which the compressor is mounted. In this construction, the gas arriving to shell 1 is admitted to the inside of a suction acoustic muffler, to be described below, which is mounted in front of the suction chamber 6, in order to attenuate the noise generated by the movement of the suction valve, avoiding or reducing the excitements of the cavity ressonances.

According to the present invention, the suction muffler comprises a closed hollow body 10 of a thermo-insulating material which is externally mounted to the head 5 and which affixes a gas duct 20, which extension internal to said hollow body 10 is spaced from the walls of the latter, said gas duct 10 defining a gas inlet portion 21 and a gas outlet portion 22.

According to the present invention, the spacing from a substantial part of the extension of the gas conduct 20 in relation to the inner walls of the hollow body 10 minimizes the heat transfer, received from the compressor, to the gas duct 20 through the hollow body and consequently to the cool gas being drawn to the suction chamber 6. The gas duct 20 is defined in order that, during the compressor operation, the gas which is being drawn maintains fluid communication with the inside of the internal chamber of the hollow body 10, dampening suction noises without however having its temperature altered to an extent that impairs the gas refrigeration state.

The gas inlet portion 21 has an inner end 21*a* opened to the inside of the hollow body 10 and an outer end 21*b*in fluid communication with the suction inlet tube 8, whereas the gas outlet portion 22 has an inner end 22*a* and an opposite end 22*b* connected with the suction orifice of the head 5.

In a non-illustrated solution, when the suction is direct or direct and hermetic between the suction inlet tube and the suction orifice of the head 5, the outer end 21*b*of the gas inlet portion 21 is directly coupled by appropriate means to said suction inlet tube. In this solution, the gas flow coming from the evaporator of the refrigeration system is admitted, without interruption, directly to the cylinder inside, before being compressed in said cylinder and discharged in a condenser of the refrigeration system.

In the illustrated construction, the gas inlet portion 21 and gas outlet portion 22 are structurally spaced from each other, each of said portions having its respective inner end 21*a*, 22*a* opened towards a portion of the hollow body 10 spaced away from the region thereof that carries said gas inlet and gas outlet portions 21, 22 of the gas duct 20. In other possible solutions, the gas duct 20 is defined in a single piece, having the inner end of each said gas inlet and gas outlet portions physically connected to each other and maintaining openings for fluid communication with an internal volume of the hollow body 10.

In a constructive option of the present solution, the hollow body 10 comprises two pieces which are attachable to each other by appropriate means, at least one of said pieces defining openings for the passage of the gas inlet and gas outlet portions 21, 22. Nevertheless, it should be understood that the present invention also foresees other constructions in which the hollow body is formed in a single piece incorporating the gas duct 20.

According to the drawings, one of the pieces of the hollow body defines a cover 11, which is trespassed by the gas inlet and gas outlet portions 21, 22 of the gas duct 20, to be affixed to a fixing opening 12 which is provided at the other of said hollow body pieces and which defines a base portion 13 for the hollow body 10, said fixing opening 12 receiving and affixing the cover 11.

In the illustrated solution, the cover 11 is provided with the openings for the passage of the gas inlet and gas outlet portions 21, 22 of the gas duct cited above, preferably incorporating said portions. In this construction, the cover 11 has a closing surface 14 where the passage openings cited above are provided.

From the peripheral edge of said closing surface 14 there is projected, orthogonally to said closing surface 14, a peripheral flange 15 provided, for example, with locking means for affixing said cover 11 to the base portion 13, when the muffler of the present invention is mounted. In this construction, the peripheral flange 15 fits into the fixing opening opening defined at the base portion 13 of the hollow body 10. The connection of the parts may be achieved, for example, by welding, gluing or also by using clamps, the latter option being preferred in terms of reliability and cost relationship.

In the solution of the present invention, the suction muffler being described is mounted suspended to the cylinder block 2, by appropriately affixing the outer end 22*b* of the gas outlet portion 22 to the suction orifice.

According to the present invention, the fluid communication between the inner end of each of the inlet and outlet portions 21, 22 of the gas duct 20 occurs through a deflector, which is formed by at least one of the parts defined by the cover 11 and base portion 13 of the hollow body 10 and which is adjacent to said inner ends 21*a*, 22*a* in order to direct the gas flow that is being drawn from the inner end 21*a* of the gas inlet portion 21 to the inner end 22*a* of the gas outlet portion 22 of the gas duct 20. According to a solution of the present invention, the deflector is defined by part of the hollow body portion that is spaced from the opening for affixing the base portion 13 thereof and located between the inner ends 21*a* and 22*a* of each of the gas inlet and outlet portions 21, 22 of the gas duct 20. In a variant of this solution, part of the deflector is further defined by a dividing portion 16, extending from the cover 11 towards the inner end of each of the gas inlet and outlet portions 21, 22 of the gas duct 20 parallely to the axis thereof and which has, for example, an inverted "T" profile.

In the illustrated construction, the dividing portion 16 extends orthogonally from the closing surface 14 and divides the inside of the base portion 13 of the hollow body 10 in two gas volumes, in order to dampen the suction noise of said gas.

According to the present invention, the outer end 21*b*of the gas inlet portion 21 is projected in order to define a volume in the gas inlet portion, which is illustrated with a rectangular cross section, although it may have any cross section, and which serves as a reservoir of cooler gas. Said solution is usually employed in order to maintain in a static condition a certain amount of cooler gas adjacent to the muffler gas inlet for the moment in which the gas begins to be drawn to the suction chamber. Such effect is important in view of the intermittent character of the gas flow established during suction in a reciprocating compressor, avoiding the occurrence of flow recirculations which facilitate the mixture of the drawn gas with the gas (hotter gas) inside the shell.

We claim:

1. A suction muffler for a hermetic compressor, including a hermetic shell (1) and having a suction inlet tube (8) for gas admission therewithin and a suction orifice which is provided in the head (5) of a cylinder disposed inside the shell (1) and where is mounted the suction muffler, characterized in that said muffler comprises a hollow body (10) affixing a gas duct (20) which is defined by a gas inlet portion (21) having an inner end **(21*a*) internal to said muffler body and an outer end (21*b*) external to said muffler body and in fluid communication with the suction inlet tube (8), and a gas outlet portion (22) having an inner end (22*a*) internal to said muffler body and an outer end (22*b*) external to said muffler body and connected to the suction orifice, the extension of the gas duct (20)** internal to the muffler body being spaced from the walls thereof.

2. A suction muffler, as in claim 1, characterized in that the hollow body (10) comprises two pieces, at least one of said pieces defining openings for the passage of the gas inlet and gas outlet portions (21, 22) of the gas duct (20).

3. A suction muffler, as in claim 2, characterized in that one of said pieces of the hollow body (10) comprises a cover (11) which is trespassed by the gas inlet and gas outlet portions (21, 22) of the gas duct (20) and which is attachable to a fixing opening (12) defined at the other of said pieces of the hollow body (10).

4. A suction muffler, as in claim 1, characterized in that the inner end **(21*a*, 22*a*) of each of the gas inlet and gas outlet portions (21, 22) of the gas duct (20)** is opened to a portion of the hollow body which is spaced from the fixing opening of the latter.

5. A suction muffler, as in claim 4, characterized in that it comprises a deflector which is formed by at least one of the parts defined by the cover (11) and base portion (13) of the hollow body (10) adjacent to the the inner end **(21*a*, 22*a*) of each of the gas inlet and gas outlet portions (21, 22) of the gas duct (20), in order to direct the gas flow from the inner end (21*a*) of the gas inlet portion (21) towards the inner end (22*a*) of the gas outlet portion (22) of the gas duct (20)**.

6. A suction muffler, as in claim 5, characterized in that the deflector is defined by the portion of the hollow body (10) which is spaced from the fixing opening (12) defined at the base portion (13) thereof and between the inner ends **(21*a*, 22*a*) of each of the gas inlet and gas outlet portions (21, 22) of the gas duct (20)**.

7. A suction muffler, as in claim 6, characterized in that the cover (11) incorporates a dividing portion (16) which extends towards the inner end **(21*a*, 22*a*) of each of the gas inlet and gas outlet portions (21, 22) of the gas duct (20) parallely to the axis thereof and which defines dampening volumes for the gas inside the hollow body (10)**.

8. A suction muffler, as in claim 7, characterized in that the dividing portion (16) has an inverted "T" profile, defining part of the deflector between the inner ends **(21*a*, 22*a*) of each of the gas inlet and gas outlet portions (21, 22) of the gas duct (20)**.

* * * * *